US008913924B2

(12) United States Patent
Aimoto

(10) Patent No.: US 8,913,924 B2
(45) Date of Patent: Dec. 16, 2014

(54) ELECTROPHOTOGRAPHIC IMAGE FORMING APPARATUS WITH ELECTROCONDUCTIVE DEVELOPER REGULATING SECTION

(71) Applicant: Sharp Kabushiki Kaisha, Osaka-shi, Osaka (JP)

(72) Inventor: Toyoka Aimoto, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 55 days.

(21) Appl. No.: 13/666,146

(22) Filed: Nov. 1, 2012

(65) Prior Publication Data

US 2013/0149007 A1 Jun. 13, 2013

(30) Foreign Application Priority Data

Dec. 13, 2011 (JP) ..... 2011-272781

(51) Int. Cl.
*G03G 15/22* (2006.01)

(52) U.S. Cl.
USPC ..... 399/148; 399/170; 399/171; 399/172; 399/173; 399/284

(58) Field of Classification Search
USPC ..... 399/148, 172, 173, 235, 274, 284, 399/170–171
See application file for complete search history.

(56) References Cited

U.S. PATENT DOCUMENTS

| | | | | |
|---|---|---|---|---|
| 4,984,018 | A * | 1/1991 | Andou et al. | 399/111 |
| 5,134,960 | A * | 8/1992 | Shirai | 399/105 |
| 6,134,405 | A * | 10/2000 | Zona | 399/148 |
| 6,191,801 | B1 | 2/2001 | Hiraoka et al. | |
| 6,600,892 | B2 * | 7/2003 | Kamimura et al. | 399/281 |
| 6,622,000 | B2 * | 9/2003 | Furukawa et al. | 399/281 |
| 8,644,741 | B2 * | 2/2014 | Hamada | 399/284 |
| 8,649,706 | B2 * | 2/2014 | Ino et al. | 399/172 |

FOREIGN PATENT DOCUMENTS

| | | |
|---|---|---|
| JP | 5-265313 A | 10/1993 |
| JP | 9-274376 | 10/1997 |
| JP | 10-69142 | 3/1998 |
| JP | 2001-75357 | 3/2001 |

OTHER PUBLICATIONS

Suzuki, Image Forming Device, Oct. 15, 1993, Patent Abstracts of Japan, JP05-265313 English Machine Translation.*

* cited by examiner

*Primary Examiner* — Clayton E Laballe
*Assistant Examiner* — Trevor J Bervik
(74) *Attorney, Agent, or Firm* — Nixon & Vanderhye, P.C.

(57) ABSTRACT

An image forming apparatus of the present invention includes: a developing section which includes a developer bearing member which bears toner to be supplied to an image bearing member on which an electrostatic latent image is formed; and a developer regulating section which regulates a layer thickness of the toner borne by the developer bearing member, the developer regulating section being electrically connected to the charger case, the developer regulating section being at least partially electroconductive.

5 Claims, 11 Drawing Sheets

ELECTROPHOTOGRAPHIC IMAGE FORMING APPARATUS WITH ELECTROCONDUCTIVE DEVELOPER REGULATING SECTION

This Nonprovisional application claims priority under 35, U.S.C. §119, on Patent Application No. 2011-272781, filed in Japan on Dec. 13, 2011, the entire contents of which are hereby incorporated by reference.

TECHNICAL FIELD

The present invention relates to a charging and developing device to be provided in an image forming apparatus which employs an electrophotographic printing method.

BACKGROUND ART

An image forming apparatus which employs an electrophotographic printing method is arranged as below. Toner, which is a component of a developer, is supplied from a developing device to an electrostatic latent image which is formed on a surface of a photoreceptor, so that a toner image which is an visible image is formed. The toner image is transferred to recording paper or the like which serves as a transfer medium. Then, a solid recording image is formed by fixing the toner image transferred to the recording paper.

The recent spread of color ink-jet image forming apparatuses requires smaller and lower-priced image forming apparatuses each employing an electrophotographic printing method.

In view of the circumstances, a nonmagnetic monocomponent developing method, which has a simple structure and can be smaller, is frequently used for a developing device to be provided in an image forming apparatus which employs an electrophotographic printing method.

For example, Patent Literature 1 describes a color electrophotographic video apparatus which forms a full color image by single-step development. A developing unit of the color electrophotographic video apparatus described in Patent Literature 1 is arranged such that a transportation device which carries toner contained in the developing unit and is a meshed belt is sandwiched between two plates of a friction device. This brings the toner which has been carried by the transportation device into contact with the two plates of the friction device. Friction between the toner and each of the two plates charges the toner.

CITATION LIST

Patent Literatures

Patent Literature 1

Japanese Patent Application Publication, Tokukaihei, No. 10-069142 (Publication Date: Mar. 10, 1998)

SUMMARY OF INVENTION

Technical Problem

However, according to a conventional technique as described above, stress which is imposed on toner by repeated rubbing in a narrow gap between two plates causes a gradual deterioration in toner and a degradation in fluidity of the toner. This causes an increase in residual toner which does not contribute to development. In addition, the toner easily aggregates and is unstable in charge amount. The conventional technique thus has a problem such that an image quality cannot be stabilized.

The present invention has been made in view of the problems, and an object of the present invention is to provide an image forming apparatus which can reduce stress imposed on toner and improve stability of an image quality.

Solution to Problem

In order to attain the object, an image forming apparatus in accordance with the present invention includes: an image bearing member; a charging section which (i) includes a charger case containing a discharge electrode and (ii) charges a surface of the image bearing member by a voltage application to each of the discharge electrode and the charger case; an exposure section which forms an electrostatic latent image by emitting light to the image bearing member thus charged; a developing section which includes a developer bearing member which bears toner to be supplied to the image bearing member on which the electrostatic latent image is formed; and a developer regulating section which regulates a layer thickness of the toner which is borne by the developer bearing member, the developer regulating section being electrically connected to the charger case, the developer regulating section being at least partially electroconductive.

According to the above arrangement, an electrostatic latent image is formed by emitting light to the image bearing member which has been charged by a voltage application to each of the discharge electrode and the charger case, the developer bearing member bears toner to be supplied to the image bearing member on which the electrostatic latent image is formed, and the developer regulating section regulates a layer thickness of the toner which is borne by the developer bearing member. The developer regulating section is electrically connected to the charger case and is at least partially electroconductive. Accordingly, when a voltage is applied to each of the discharge electrode and the charger case, an electric current which flows through the charger case is conducted also to the developer regulating section.

The developer regulating section is in contact with toner on the developer bearing member so as to regulate a layer thickness of the toner which is borne by the developer bearing member. This allows the developer regulating section to inject an electric charge into the toner on the developer bearing member. Therefore, the toner on the developer bearing member can be charged by the electric current which has been conducted from the charger case to the developer regulating section.

Therefore, it is possible for the charging section to charge not only the image bearing member but also toner on the developer bearing member. This enables efficient charging. In addition, the charging section sufficiently charges the toner which is borne by the developer bearing member. Therefore, unlike a conventional developer regulating section, the developer regulating section does not need to subject the toner which is borne by the developer bearing member to a great frictional force so as to charge the toner. Therefore, it is possible to provide an image forming apparatus which can reduce stress imposed on toner and improve stability of an image quality.

Advantageous Effects of Invention

The present invention yields an effect of allowing toner to continue to be in a preferable state and stabilizing a charge amount of toner.

BRIEF DESCRIPTION OF DRAWINGS

FIG. 1 is a cross-sectional view showing an overall arrangement of an image forming apparatus in accordance with an embodiment of the present invention.

FIG. 2 is a cross-sectional view schematically showing an arrangement of a conventional developing device.

FIG. 3 is a cross-sectional view schematically showing, together with a charging charger unit, an arrangement of a developing device in accordance with the embodiment of the present invention.

FIG. 4 is an enlarged cross-sectional view showing, together with a developing roller, an arrangement of the charging charger unit in accordance with the embodiment of the present invention.

FIG. 5 is an exploded perspective view showing a structure of the charging charger unit.

FIG. 6 is an enlarged view showing an example of a surface of a grid sheet metal.

FIG. 7 is a cross sectional view showing, together with a developing roller, a charging charger unit in accordance with a second embodiment of the present invention.

FIG. 8 is an exploded perspective view showing a structure of the charging charger unit in accordance with the second embodiment.

FIG. 9 is a graph showing an experimental result obtained by charging toner on a developing roller.

FIG. 10 shows a structure of a needle electrode.

FIG. 11 is an enlarged view showing a structure of a needle part of a needle electrode.

DESCRIPTION OF EMBODIMENTS

Figure 1:
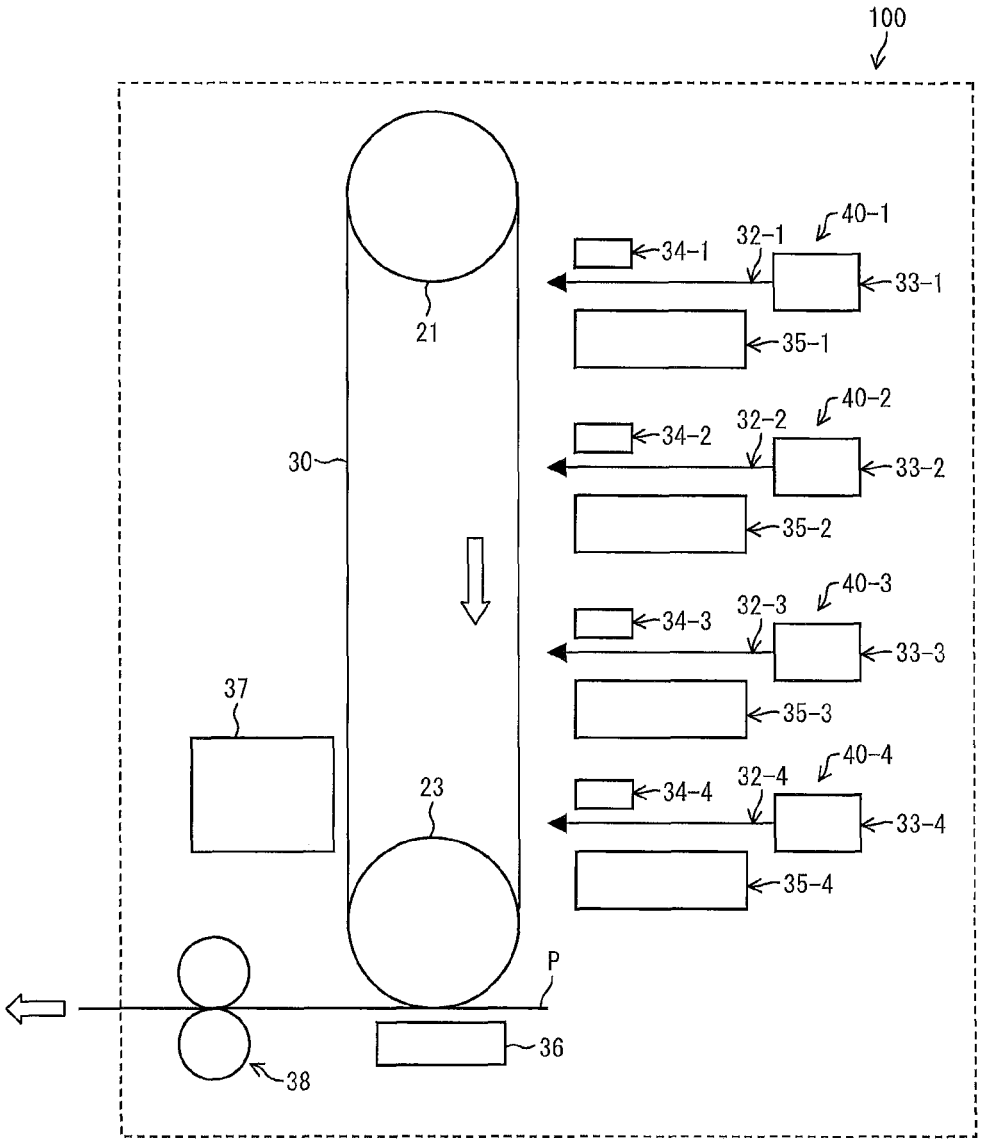
FIG. 1

The following description discusses embodiments of the present invention with reference to the drawings. In the following description, identical reference numerals are given to respective identical parts. Those identical parts are also identical in name and function. This prevents a repeated specific description of the identical parts.

<First Embodiment>

FIG. 1 is a cross-sectional view showing an overall arrangement of an image forming apparatus in accordance with an embodiment of the present invention. An image forming apparatus 100 has, as printing modes, a copying mode (a photocopying mode), a printer mode, and a FAX mode. A control section selects one of the printing modes which is in accordance with an operation carried out by an operation section (not shown) and/or a printing job received from an external host device such as a personal computer. The following description discusses the copying mode of the printing modes.

The copying mode is arranged as below. A user places a document on a platen glass (not shown) of a document reading section (not shown) and presses a condition input key (e.g., the number of sheets to be printed and/or a printing magnification) on an operation panel (not shown) which is provided in a front part of an exterior of the image forming apparatus. Then, the user presses a start key on the operation panel to start a copying operation.

Meanwhile, in the document reading section, a copy lamp (not shown) turns on, and light which has been emitted from the copy lamp to the document becomes reflected light (reflected light from the document) which contains image information of the document. The reflected light is read by being supplied to a CCD (not shown) through a mirror (not shown) and an optical lens (not shown) which are provided in a copy lamp unit.

A CCD circuit (not shown) converts optical image information thus read to an electrical image information signal. Then, image processing is carried out under a set condition in accordance with the electrical image information signal.

The image forming apparatus 100 includes a photoreceptor belt (image bearing member) 30, a driven roller 21, a driving roller 23, four image forming stations 40-*n* (n: 1 to 4), a transfer unit (transfer section) 36, a cleaning unit 37, and a fixing device (fixing section) 38 (see FIG. 1).

The driving roller 23 and the driven roller 21 are provided in the photoreceptor belt 30 so as to extend the photoreceptor belt 30 therebetween. The photoreceptor belt 30 is driven to rotate simultaneously with driving of the driving roller 23 by a driving motor (not shown).

Each of the four image forming stations 40-*n* is provided so as to face the photoreceptor belt 30 while a predetermined gap is provided between the respective four image forming stations 40-*n*. The four image forming stations 40-*n* use respective different colors to form respective toner images. Specifically, the four image forming stations 40-*n* use cyan (C) toner, magenta (M) toner, yellow (Y) toner, and black (K) toner to form respective toner images.

An image forming station 40-*n* includes a charging charger unit (charging section) 34-*n* a laser scanner unit (exposure section) 33-*n* and a developing device (developing section) 35-*n*. Note that the four image forming stations 40-*n* are identical in arrangement and function except that the four image forming stations 40-*n* differ in color of a toner image to be formed and in arrangement location. Therefore, the present embodiment discusses the image forming station 40-*n* by taking the image forming station 40-1 as an example.

A charging charger unit 34-1 charges, by discharge, a surface of the photoreceptor belt 30 so that the surface of the photoreceptor belt 30 has a predetermined electric potential.

A laser scanner unit 33-1 is provided downstream with respect to the charging charger unit 34-1 in a direction in which the photoreceptor belt 30 rotates. The laser scanner unit 33-1 includes a laser emitting section, a reflecting mirror or the like, a polygon mirror which scans a laser beam emitted from the laser emitting section, and optical elements such as a lens and a mirror for guiding, to the photoreceptor belt 30, laser light reflected by the polygon mirror. Alternatively, the laser scanner unit 33-1 can employ a method using, for example, an EL or LED writing head in which light-emitting elements are provided in an array pattern.

The laser scanner unit 33-1 exposes the photoreceptor belt 30 to light in accordance with the image information signal which is supplied from the CCD circuit, so as to form an electrostatic latent image in accordance with the image information signal on the surface of the photoreceptor belt 30.

A developing device 35-1 is provided downstream with respect to the laser scanner unit 33-1 in the direction in which the photoreceptor belt 30 rotates. The developing device 35-1 uses toner to reveal the electrostatic latent image formed on the photoreceptor belt 30.

The transfer unit 36 is provided so as to face the driving roller 23 which is provided in the photoreceptor belt 30. The transfer unit 36 receives a high voltage applied by a high voltage power supply (not shown). At a location at which the transfer unit 36 faces the photoreceptor belt 30, the transfer unit 36 transfers a toner image on the photo receptor belt 30 onto paper (a recording medium) P which has been timely carried by a registration roller (not shown).

The cleaning unit 37 is provided on a first side of the photoreceptor belt 30 which first side is opposite from a second side of the photoreceptor belt 30 on which second side the four image forming stations 40-*n* are provided. After the photoreceptor belt 30 has been subjected to development and image transfer, the cleaning unit 37 removes residual toner on the photoreceptor belt 30 by scraping off the residual toner with a cleaning blade. The cleaning unit 37 also collects the residual toner thus removed.

The fixing device 38 includes a heating roller and a pressure roller. The heating roller and the pressure roller rotate with paper sandwiched therebetween. The heating roller is controlled to have a predetermined fixing temperature. The fixing device 38 rotates with the paper P sandwiched between the heating roller and the pressure roller, the paper P having been subjected to transfer and being carried by the photoreceptor belt 30, so as to fix a toner image formed on the paper P. The paper P on which the toner image has been fixed is discharged to a paper output tray (not shown) by a paper output roller (not shown).

Figure 3:
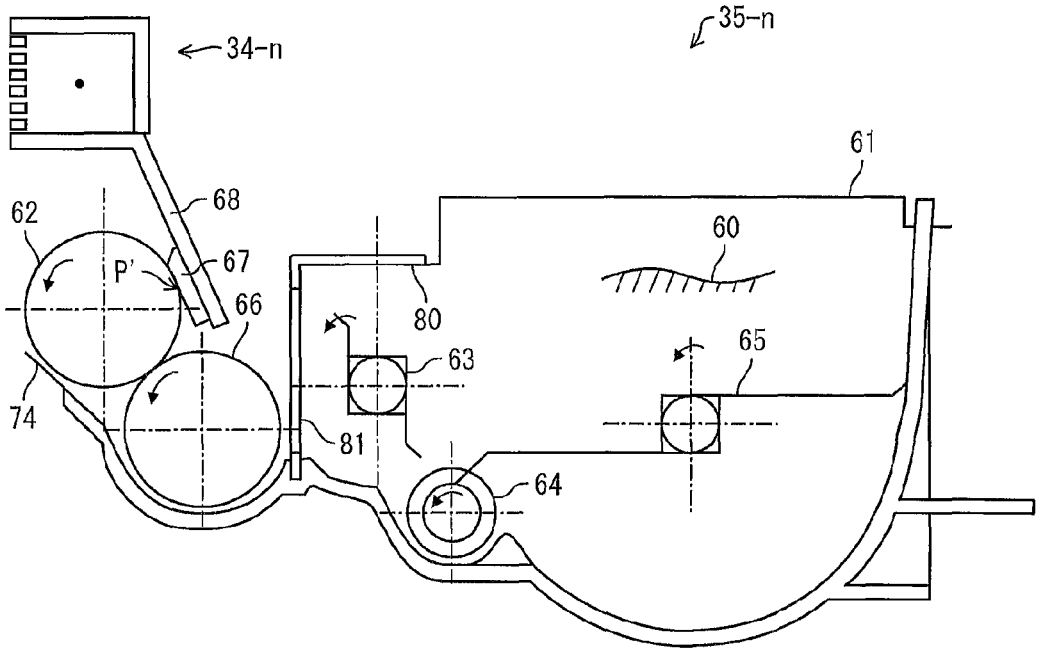
FIG. 3
Figure 4:
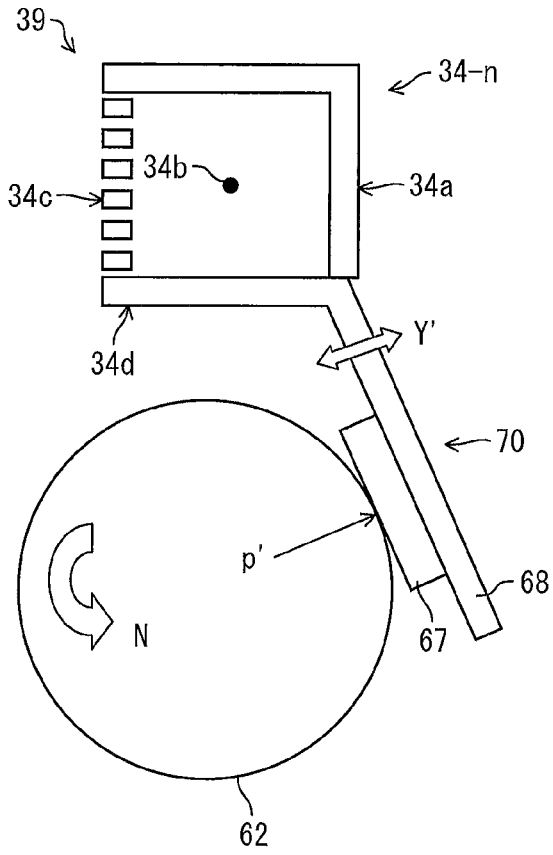
FIG. 4

FIG. 3 is a cross-sectional view schematically showing, together with the charging charger unit, an arrangement of the developing device in accordance with the embodiment of the present invention. FIG. 4 is an enlarged cross-sectional view showing, together with a developing roller, an arrangement of the charging charger unit in accordance with the embodiment of the present invention.

The developing device 35-*n* includes a developing roller (developer bearing member) 62 which bears a developer, a toner supply roller 66, a developing tank 61 which contains a developer, and a plurality of stirring and carrying members 63 to 65 each of which stirs and carries a developer 60 in the developing tank 61 (see FIGS. 3 and 4).

The developing tank 61 is made of, for example, a hard synthetic resin, and serves as a container which has a substantially rectangular shape in appearance. The developing tank 61 contains the developer 60. The developer 60 is exemplified by a nonmagnetic one-component developer.

Each of a first stirring and carrying member 65 and a second stirring and carrying member 63 stirs and carries the developer 60 contained in the developing tank 61. Specifically, in a case where blades which are provided around respective rotation axes of the first stirring and carrying member 65 and the second stirring and carrying member 63 rotate simultaneously with driving of the rotation axes, each of the first stirring and carrying member 65 and the second stirring and carrying member 63 stirs and carries the developer 60 contained in the developing tank 61. The blades of the first stirring and carrying member 65 and the second stirring and carrying member 63 are made of, for example, a thin resin, particularly preferably of PET.

A third stirring and carrying member 64 is a screw-shaped rotating member which mainly stirs and carries toner that is in an axial direction. The rotating member is made of, for example, a hard synthetic resin.

An intermediate wall member 80 is provided between the second stirring and carrying member 63 and the toner supply roller 66. The intermediate wall member 80 is a flat-plate member made of, for example, a synthetic resin. The intermediate wall member 80 is provided so that one side thereof extends in a longer side direction of the developing tank 61 and the other side thereof stands upright from a bottom of the developing tank 61. The intermediate wall member 80 has an opening hole 81 at a center thereof, and forms, in the developing tank 61, a flow of a developer which moves from the second stirring and carrying member 63 to the toner supply roller 66.

The toner supply roller 66 is provided with a cylindrical porous elastic member around a shaft thereof. The porous elastic member is exemplified by expanded urethane. The toner supply roller 66 supplies toner to the developing roller 62 by adhering the toner to holes of the porous elastic member while rubbing the toner against the developing roller 62. This allows the developer 60 to be supplied to the developing roller 62 in a given amount. After development, the toner supply roller 66 also has a function of cleaning residual toner left in the developing roller 62.

The developing roller 62 is an aluminum roller which is driven by drive means (not shown) to rotate on its axis. The developing roller 62 is provided so as to face the photoreceptor belt 30 with a given gap between the developing roller 62 and the photoreceptor belt 30. The developing roller 62 is supported by a frame part (not shown) of the developing tank 61. The developing roller 62 bears, on a surface thereof, the developer 60 which has been supplied from the toner supply roller 66. Then, the developing roller 62 supplies, to the photoreceptor belt 30, the developer 60 thus borne on the surface thereof.

The charging charger unit 34-*n* is provided above the developing tank 61, specifically above the developing roller 62. The charging charger unit 34-*n* employs a noncontact method using corona charging. The charging charger unit 34-*n* includes (i) a charger case 39 which is integrated with a developer regulating unit 70 and is electroconductive and (ii) a charger line (discharge electrode) 34*b* to which a high voltage is applied. The charger line 34*b* is provided in the charger case 39 and shielded.

The charger case 39 has a hollow prism shape which surrounds the charger line 34*b*. A grid sheet metal 34*c* is provided on a side surface of the charger case 39 which side surface faces the photoreceptor belt 30. The grid sheet metal 34*c* is a mesh member which has a plurality of openings and is electroconductive. The openings may have, for example, a slit or polygonal shape.

The charger case 39 is arranged such that a top surface, a side surface which faces the grid sheet metal 34*c*, and an undersurface which faces the developing roller 62 are constituted by sheet metals 34*a* and 34*d* on each of which no grid is provided. A voltage lower than a voltage applied to the charger line 34*b* is applied to each of the sheet metals 34*a* and 34*d* and the grid sheet metal 34*c*. This causes discharge from the charger line 34*b* to the sheet metals 34*a* and 34*d* and the grid sheet metal 34*c*. Therefore, it is possible to charge the photoreceptor belt 30 which faces the grid sheet metal 34*c*. In addition, it is possible to conduct, to the developer regulating unit 70, an electric current which flows through the charger case 39. This is because the developer regulating unit 70 is integrated and electrically connected with the charger case 39.

The charger case 39 is provided such that the charger line 34*b* faces the photoreceptor belt 30 via the grid sheet metal 34*c*. The charger line 34*b* is provided so that its axial direction is perpendicular to the direction in which the photoreceptor belt 30 rotates.

A part of the sheet metal 34*d* which is the undersurface of the charger case 39 and faces the developing roller 62 extends toward the developing roller 62. Such an extending part corresponds to the developer regulating unit 70. The developer regulating unit 70 includes a doctor blade sheet metal 68 and a developer regulating member 67.

The doctor blade sheet metal 68 is a thin sheet metal having a spring property and is substantially identical in length to a longer side direction of the developing roller 62. Assuming that a part of the doctor blade sheet metal 68 which part is close to the sheet metal 34*d* is an upper part of a surface of the doctor blade sheet metal 68, a middle part to a lower part of the surface of the doctor blade sheet metal 68 is adjacent to and faces the developing roller 62.

The developer regulating member 67 is fixed from the middle to lower part of the surface of the doctor blade sheet metal 68. A cross section along a direction perpendicular to a longer side direction of the developer regulating member 67 is substantially rectangular. The developer regulating member 67 is in contact with the developing roller 62 at a contact point p' on the developing roller 62. Note that the developer regulating member 67 is suitably made of urethane rubber.

The developer regulating member 67 which is subjected to an elastic force of the doctor blade sheet metal 68 supplies a pressing force (a load P) at the contact point p' on the developing roller 62. Note here that the developing roller 62 rotates in an arrow N (counterclockwise) direction and bears, just before the contact point p', toner which has been supplied from the toner supply roller 66. Accordingly, the rotation of the developing roller 62 allows the toner borne just before the contact point p' to flow into the contact point p', so that a layer thickness of the toner is adjusted. The toner which has flowed into the contact point p' is subjected to a frictional force by the developing roller 62 and the developer regulating member 67, and the toner is charged.

The toner which has passed through the contact point p' is carried to a developing position which faces the photoreceptor belt 30, and then the toner is used to develop a toner image.

Since toner on the developing roller 62 is in proximity to the doctor blade sheet metal 68, the toner on the developing roller 62 is charged not only by friction but also by an electric current which has been conducted from the charger case 39 to the doctor blade sheet metal 68. Therefore, the developer regulating unit 70 is adjusted to apply a smaller pressure to the developing roller 62 at the contact point p' than a conventional developer regulating unit. This makes it possible to reduce excessive stress to be imposed on toner.

Note that a force with which the doctor blade sheet metal 68 causes the developer regulating member 67 to press the developing roller 62 is set as below. A pressing force mainly uses an elastic force of the doctor blade sheet metal 68. That is, the pressing force is adjusted depending on to what extent the doctor blade sheet metal 68 which is in contact with the developing roller 62 is bent (in a Y' direction). Theoretically, the pressing force is expressed by the following well-known formula for cantilever:

$$\text{Force } P(kgf)=3EI\delta/L^3$$

where E is a Young's modulus of a material of a blade instructing section, I is a geometrical moment of inertia, δ is a bending amount, and L is a free length.

Note that an actual experiment is carried out as below. One end of a PET member which has been cut into a strip is sandwiched between the developer regulating member 67 and developing roller 62, and the other end of the PET member is connected to a tension gauge, so that an evaluation is made based on a drawing force obtained when the PET member is drawn at a given speed. For the tension gauge, RX-5 manufactured by AIKOH ENGINEERING CO., LTD is used. According to the present invention, the drawing force is adjusted to approximately 0.03 kgf/cm to 0.05 kgf/cm.

Figure 5:
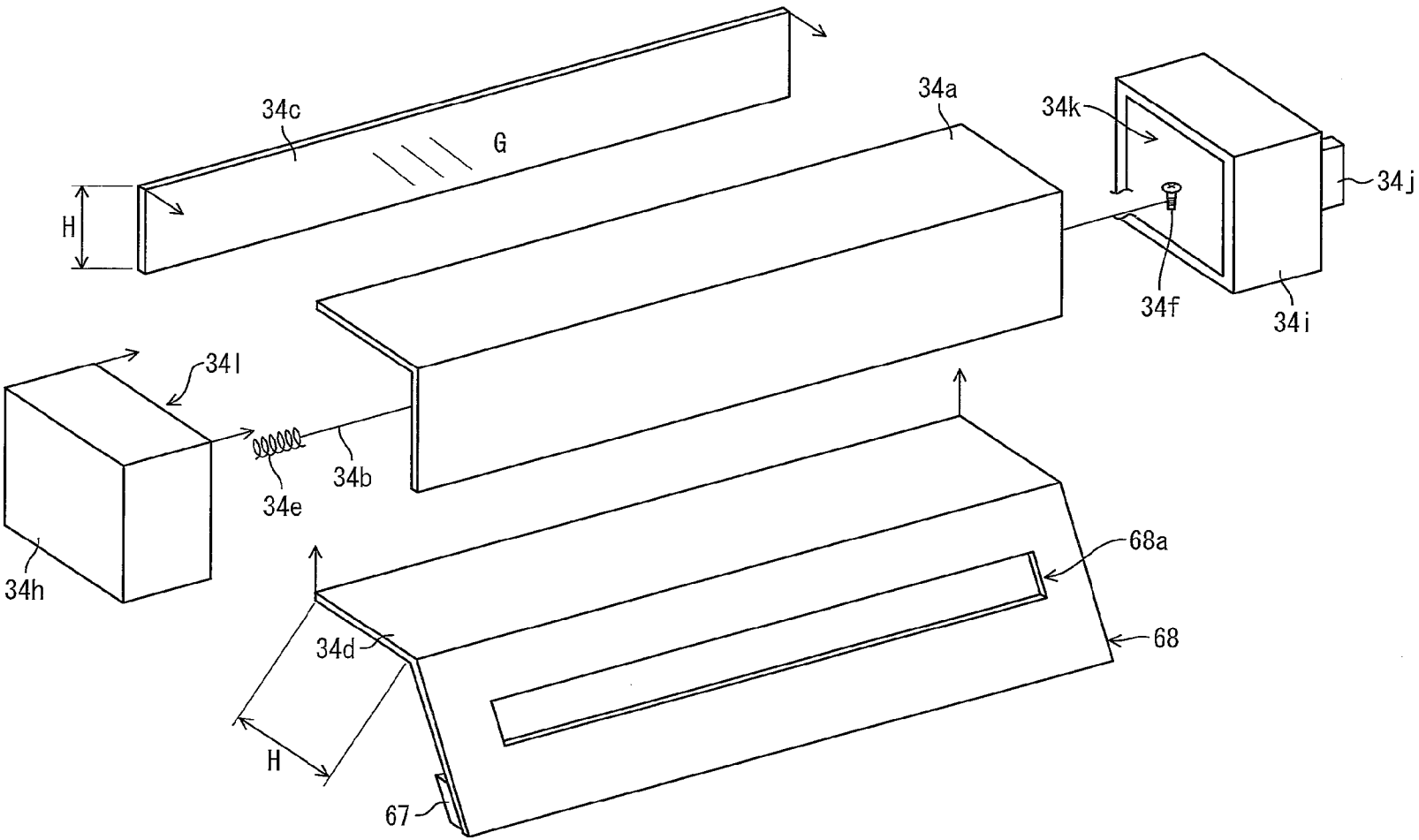
FIG. 5

FIG. 5 is an exploded perspective view showing a structure of the charging charger unit. The following description specifically discusses a structure of the charging charger unit 34-*n* with reference to FIG. 5. The doctor blade sheet metal 68 has an opening 68*a* in an upper part of its surface (a part to which the developer regulating member 67 is not provided). The opening 68*a* is provided in a region through which light emitted from the laser scanner unit 33-*n* to the photoreceptor belt 30 passes. Therefore, the doctor blade sheet metal 68 is structured so as not to block light to be led to the photoreceptor belt 30.

The charger case 39 has sheet metal holders 34*h* and 34*i* which are provided on a front side surface and a backside surface, respectively, of the charger case 39. The sheet metal holders 34*h* and 34*i* are fixed firmly to sheet metals 34*a* and 34*d* and a grid sheet metal 34*c* with a screw (not shown) or the like. This causes the charger case 39 to be a unit in which the sheet metals 34*a* and 34*d* and the grid sheet metal 34*c* are sandwiched between the sheet metal holders 34*h* and 34*i*.

The sheet metal holders 34*h* and 34*i* are resinous and substantially box-shaped. Each of the sheet metal holders 34*h* and 34*i* has a recessed inner part (see 34*l* and 34*k*).

Each of the sheet metal holders 34*h* and 34*i* also has an inner wall shape such that the sheet metals 34*a* and 34*d* and the grid sheet metal 34*c* are fit into the holders with no play.

Moreover, each of the sheet metal holders 34*h* and 34*i* retains a charger line 34*b* therein. Specifically, both ends of the charger line 34*b* are fixed to the respective sheet metal holders 34*h* and 34*i* via a coil spring 34*e* and a screw 34*f*, respectively. The coil spring 34*e* is provided for stretching the charger line 34*b* to which a tension is applied.

The sheet metal holder 34*i* has an electrode 34*j* provided at one end thereof. The electrode 34*j* applies a voltage, to the charger line 34*b*, from a voltage supply circuit provided in a machine. A value of the voltage is optimized depending on a condition of each machine. According to the present invention, a voltage of approximately DC 700V to DC 1200V is applied.

The grid sheet metal 34*c* is a thin stainless plate such as SUS 304 or the like, and has a thickness of approximately 0.1 mm. A surface G of the grid sheet metal 34*c* shows that a plurality of openings are uniformly provided. The grid sheet metal 34*c* which is made of stainless steel is less likely to deteriorate in material and secures its strength. Note that FIG. 5 shows a width H of the sheet metals 34*a* and 34*d* and the grid sheet metal 34*c*. Alternatively, the width can be optimized in accordance with various conditions of a machine to be provided.

Figure 6:
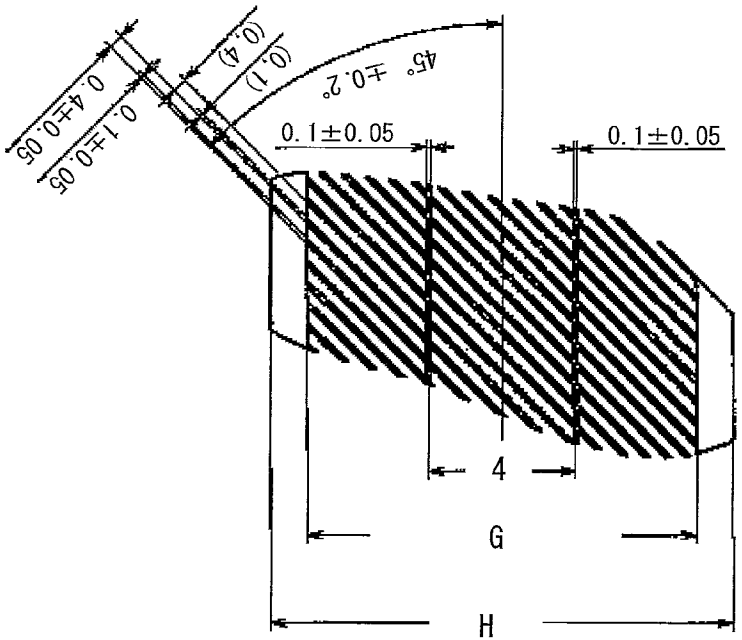
FIG. 6

FIG. 6 is an enlarged view showing an example of a surface of a grid sheet metal. A sheet metal part which constitutes the surface G of the grid sheet metal 34*c* has a width of 0.1 mm, and a gap between respective adjacent grids has a width of 0.3 mm (see FIG. 6). It goes without saying that the widths are not limited to these but may be altered depending on a device. Same applies to a material of which the grid sheet metal is made. Note that the numerical values shown in FIG. 6 exemplify the widths.

As described above, the charging charger unit 34-*n* is provided so as to face the photoreceptor belt 30, and the charger case 39 includes the grid sheet metal 34*c* provided on its side surface which faces the photoreceptor belt 30.

This enables the charging charger unit 34-*n* to charge the photoreceptor belt 30.

Note here that the charging charger unit 34-*n* is provided above the developing roller 62 included in the developing device 35-*n* the doctor blade sheet metal 68 of the developer regulating unit 70 is provided integrally with the charger case 39, and the doctor blade sheet metal 68 extends to a vicinity of the developing roller 62. Therefore, an electric current which does not contribute to charging of the photoreceptor belt 30 and flows through the charger case 39 is conducted to the doctor blade sheet metal 68. This makes it possible to simultaneously charge the photoreceptor belt 30 and toner on the developing roller 62 which is located in the vicinity of the doctor blade sheet metal 68. According to this, it is possible to effectively use an electric current flowing through the charger case 39.

That is, the arrangement enables the toner on the developing roller 62 to be charged also by an electric charge supplied from the doctor blade sheet metal 68, the toner being charged by being subjected to friction at the contact point p' on the developer regulating member 67.

Figure 2:
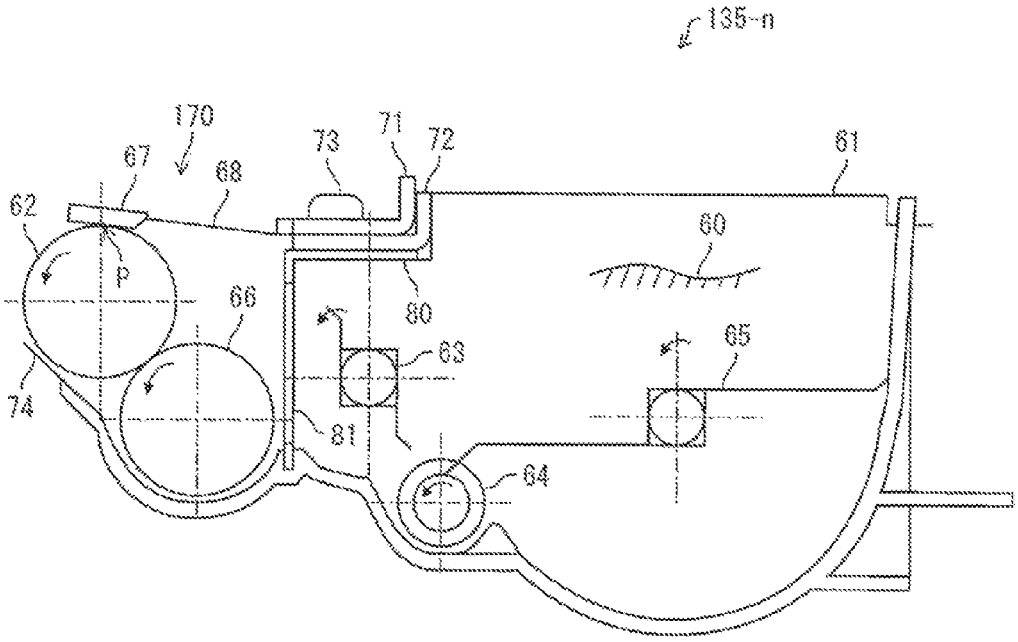
FIG. 2 PRIOR ART
FIG. 2

The following description discusses a conventional developing device. FIG. 2 is a cross-sectional view schematically showing an arrangement of a conventional developing device. A developing device 135-*n* (see FIG. 2) differs from the developing device 35-*n* (see FIG. 3) in arrangement such that the developing device 135-*n* is provided with a developer regulating unit 170 instead of the charging charger unit 34-*n*. In this case, no opening 68*a* is provided to a doctor blade sheet metal 68. The other arrangements of the developing device 135-*n* are identical to those of the developing device 35-*n*. Therefore, the following description mainly discusses the arrangement of the developing device 135-*n* which arrangement differs from that of the developing device 35-*n*.

The developer regulating unit 170 includes a developer regulating member 67, a doctor blade sheet metal 68, and a plurality of fixing sheet metals 71 and 72.

The doctor blade sheet metal 68 extends in a longer side direction of a developing tank 61. The plurality of fixing sheet metals 71 and 72 between which an end of the doctor blade sheet metal 68 is sandwiched are fixed, with a screw or the like, to a part of an intermediate wall member 80 included in the developing device 135-*n* the part extending in a longer side direction of the developing tank 61.

The developer regulating member 67 which is subjected to an elastic force of the doctor blade sheet metal 68 supplies a pressing force (a load P) at the contact point p on the developing roller 62. Note here that the developing roller 62 rotates in an arrow N (counterclockwise) direction and bears, just before the contact point p, toner which has been supplied from the toner supply roller 66. Accordingly, the rotation of the developing roller 62 allows the toner borne just before the contact point p to flow into the contact point p, so that a layer thickness of the toner is adjusted. The toner which has flowed into the contact point p is subjected to a frictional force by the developing roller 62 and the developer regulating member 67, and the toner is charged. The toner which has passed through the contact point p is carried to a developing position which faces the photoreceptor belt 30, and then the toner is used to develop a toner image.

As described above, according to the conventional developing device 135-*n*, no electric charge is supplied to the doctor blade sheet metal 68. Therefore, merely friction is used to charge toner on a developing roller.

In contrast, the charging charger unit 34-*n* in accordance with the present embodiment can compensate for a charge amount which is insufficiently covered by friction generated at the contact point p' on the developer regulating member 67. This allows the doctor blade sheet metal 68 to apply a reduced pressure to the developing roller 62. According to this, a deterioration in toner can be prevented, so that an image quality can be stabilized.

<Second Embodiment>

Figure 7:
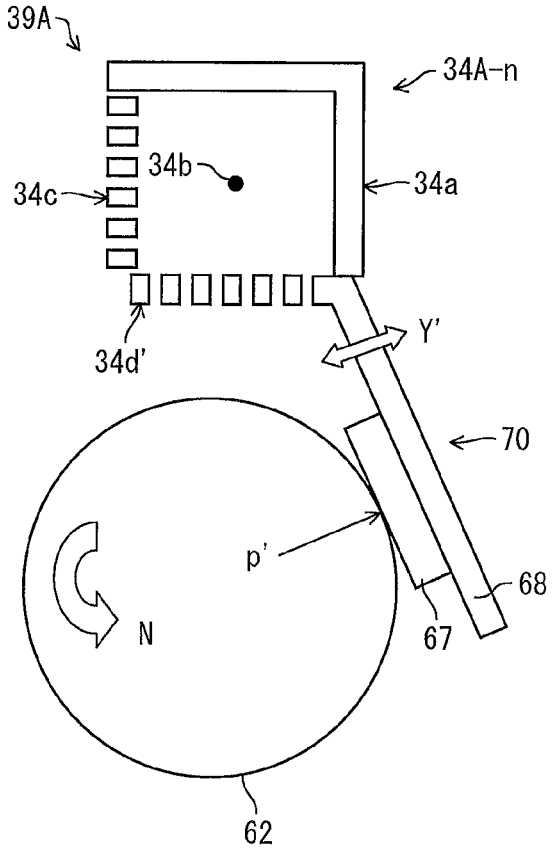
FIG. 7
Figure 8:
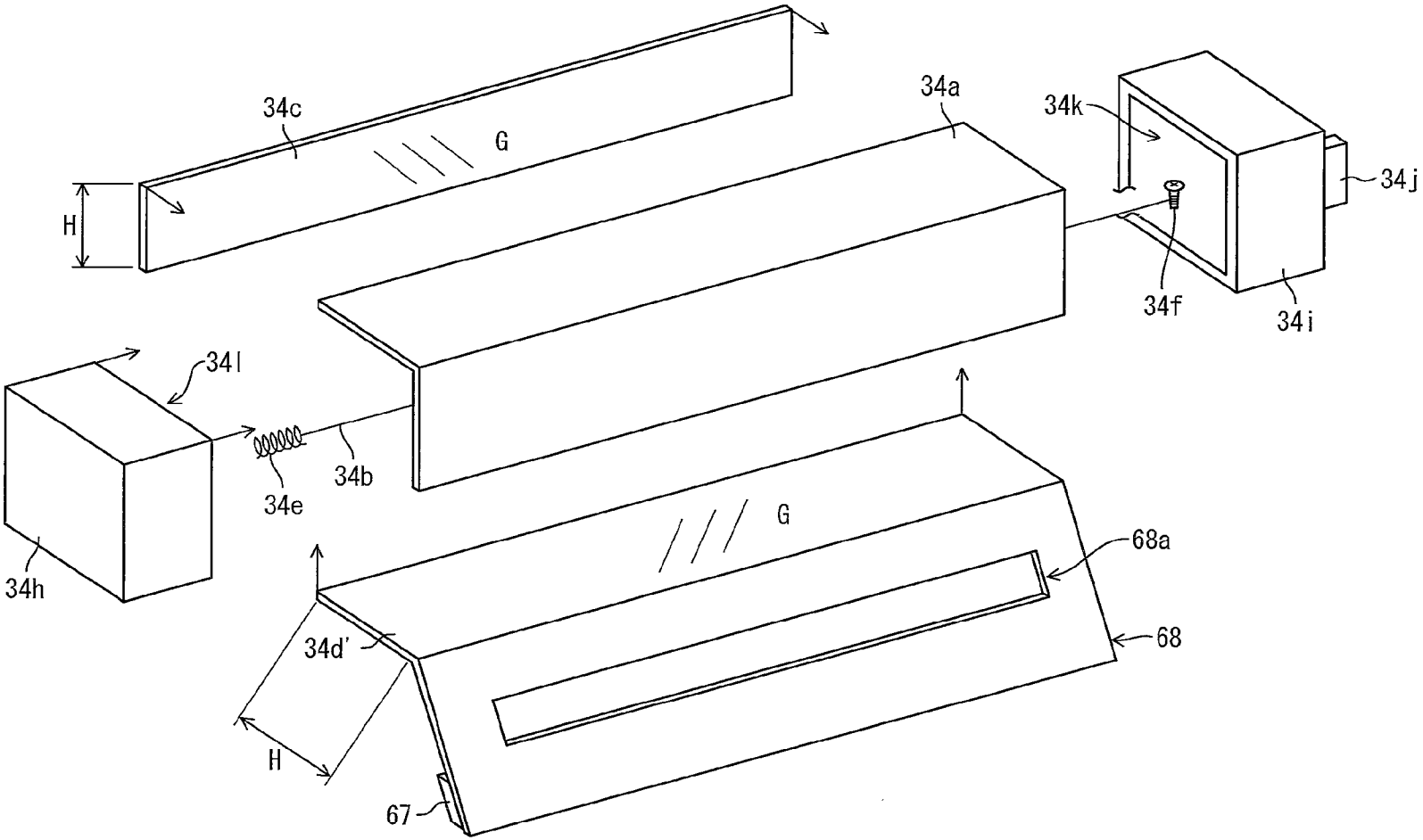
FIG. 8

FIG. 7 is a cross sectional view showing, together with a developing roller, a charging charger unit in accordance with a second embodiment. FIG. 8 is an exploded perspective view showing a structure of the charging charger unit in accordance with the second embodiment. According to the second embodiment, a charging charger unit 34A-*n* is arranged to include a charger case 39A which has a grid sheet metal 34*d*' on its undersurface facing a developing roller 62. The grid sheet metal 34*d*' is identical to a grid sheet metal 34*c* in structure. Since other arrangements of a developing device in accordance with the second embodiment are identical to those of the developing device 35-*n* in accordance with the first embodiment, no specific description thereof is repeated.

The charging charger unit 34A-*n*, is provided above the developing roller 62 of the developing device 35-*n* so as to face the photoreceptor belt 30. The charger case 39A of the charging charger unit 34A-*n* has the grid sheet metals 34*c* and 34*d*' on (i) its side surface which faces the photoreceptor belt 30 and (ii) the undersurface which faces the developing roller 62, respectively. This allows the charging charger unit 34A-*n* to simultaneously charge the photoreceptor belt 30 and toner on the developing roller 62.

The toner on the developing roller 62 is charged not only by being subjected to friction generated at a contact point p' on a developer regulating member 67 but also by the charging charger unit 34A-*n*.

Moreover, a sheet metal 34*a* of the charger case 39A does not contribute to charging of the photoreceptor belt 30 and the toner on the developing roller 62. However, since a doctor blade sheet metal 68 is integrated with the charger case 39A, an electric current which does not contribute to charging of the photoreceptor belt 30 and the toner on the developing roller 62 is conducted from the charger case 39A to the doctor blade sheet metal 68. This allows charging of the toner on the developing roller 62 which is located in the vicinity of the doctor blade sheet metal 68. According to this, it is possible to effectively use an electric current flowing through the charger case 39A.

As described above, the charging charger unit 34A-*n* can compensate for a charge amount which is insufficiently covered by friction generated at the contact point p' on the developer regulating member 67. This allows the doctor blade sheet metal 68 to apply a reduced pressure to the developing roller 62. According to this, a deterioration in toner on the developing roller 62 can be prevented, so that an image quality can be stabilized.

Figure 9:
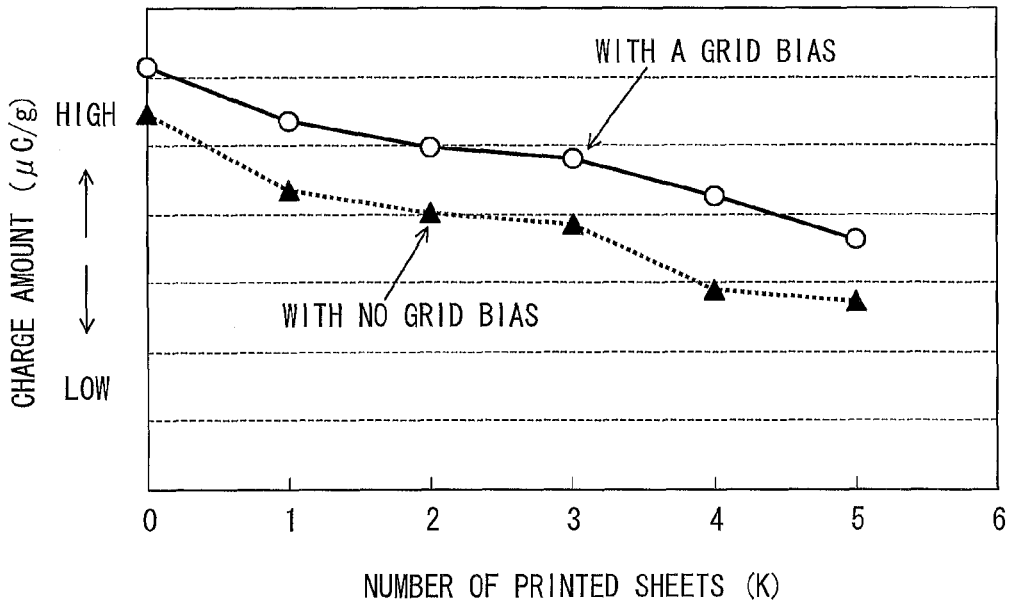
FIG. 9

FIG. 9 is a graph showing an experimental result obtained by charging toner on a developing roller. The horizontal axis of the graph shows the number of printed sheets, and the vertical axis of the graph shows a charge amount of toner on the developing roller 62.

A graph which is indicated by "with a grid bias" shows a result obtained when toner on the developing roller 62 is charged by the charging charger unit 34A-n in accordance with the second embodiment, whereas a graph which is indicated by "with no grid bias" shows a result obtained when toner on the developing roller 62 is charged by the developing device 135-*n* which is a conventional developing device (see FIG. 9). In each of the two graphs, the charge amount of toner on the developing roller 62 decreases as the number of printed sheets increases. However, it is revealed that the graph indicated by "with a grid bias" shows a smaller decrease in charge amount than the graph indicated by "with no grid bias". It is also revealed that toner on the developing roller 62 is charged more sufficiently in the graph indicated by "with a grid bias" than in the graph indicated by "with no grid bias". Note that the following are main specifications in the present experiment.

Developing roller; outer diameter of 16 mm

Photoreceptor belt; OPC belt

Toner supply roller; outer diameter of 16 mm

Process speed; 145 mm/sec solid image density can be measured by use of a portable spectrodensitometer (product name: X-Rite 939 manufactured by X-Rite, Inc.). A charge amount of toner can be measured by use of Model 210HS-2A manufactured by TREK, INC.

As described above, an image forming apparatus 100 in accordance with the present invention includes: a photoreceptor belt 30; a charging charger unit 34-*n* which (i) includes a charger case 39 containing a charger line 34*b* and (ii) charges a surface of the photoreceptor belt 30 by a voltage application to each of the charger line 34*b* and the charger case 39; a laser scanner unit 33-*n* which forms an electrostatic latent image by emitting light to the photoreceptor belt 30 thus charged; a developing device 35-*n* which includes a developing roller 62 which bears toner to be supplied to the photoreceptor belt 30 on which the electrostatic latent image is formed; and a developer regulating unit 70 which regulates a layer thickness of the toner which is borne by the developing roller 62, the developer regulating unit 70 being electrically connected to the charger case 39, the developer regulating unit 70 being at least partially electroconductive.

Therefore, an electrostatic latent image is formed by emitting light to the photoreceptor belt 30 which has been charged by a voltage application to each of the charger line 34*b* and the charger case 39, the developing roller 62 bears toner to be supplied to the photoreceptor belt 30 on which the electrostatic latent image is formed, and the developer regulating unit 70 regulates a layer thickness of the toner which is borne by the developing roller 62. The developer regulating unit 70 is electrically connected to the charger case 39 and is at least partially electroconductive. Accordingly, when a voltage is applied to each of the charger line 34*b* and the charger case 39, an electric current which flows through the charger case 39 is conducted also to the developer regulating unit 70.

The developer regulating unit 70 is in contact with toner on the developing roller 62 so as to regulate a layer thickness of the toner which is borne by the developing roller 62. This allows the developer regulating unit 70 to inject an electric charge into the toner on the developing roller 62. Therefore, the toner on the developing roller 62 can be charged by the electric current which has been conducted from the charger case 39 to the developer regulating unit 70.

Therefore, it is possible for the charging charger unit 34-*n* to charge not only the photoreceptor belt 30 but also toner on the developing roller 62. This enables efficient charging. In addition, the charging charger unit 34-*n* sufficiently charges the toner which is borne by the developing roller 62. Therefore, unlike a conventional developer regulating unit, the developer regulating unit 70 does not need to subject the toner which is borne by the developing roller 62 to a great frictional force so as to charge the toner. This makes it possible to reduce a deterioration in toner and thus allows further stabilization of an image quality.

Note that the first embodiment discusses an arrangement (scorotron type) in which the charger case 39 included in the charging charger unit 34-*n* has the grid sheet metal 34*c* on its side surface which faces the photoreceptor belt 30. However, an arrangement of the charger case 39 is not limited to this. The charger case 39 may have an arrangement (corotron type) such that the side surface which faces the photoreceptor belt 30 is opened, that is, no grid sheet metal is provided.

Similarly, according to the second embodiment, the charger case 39A is arranged such that grids are provided to both the side surface which faces the photoreceptor belt 30 and the undersurface which faces the developing roller 62. However, at least one of the side surface and the undersurface may be opened.

Figure 10:
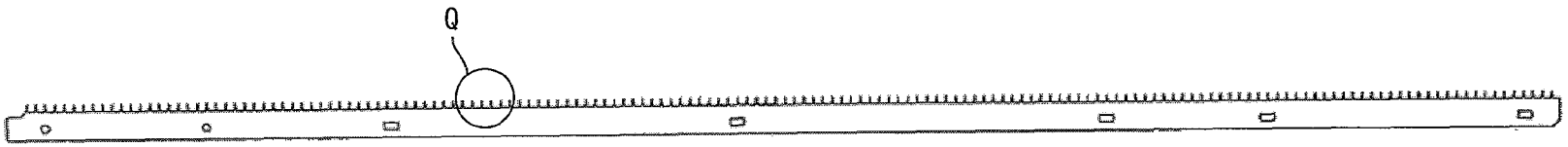
FIG. 10
Figure 11:
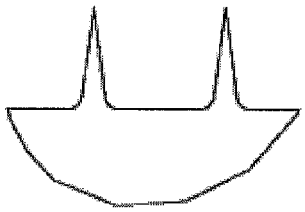
FIG. 11

According to the present invention, each of the charger cases 39 and 39A may include a needle electrode (see FIG. 10) instead of the charger line 34*b*. For example, the needle electrode is made of stainless steel and has a thickness of approximately 0.1 mm. A lower part of the needle electrode is fixed to a main body of the charger case 39 or 39A with a holding member such as a resin. Note that an upper part of the needle electrode is provided with needle-shaped protrusions. Specifically, each of the needle-shaped protrusions has a structure shown in FIG. 11 which is an enlarged view of a needle part Q.

The present invention is not limited to the description of the embodiments above, but may be altered by a skilled person within the scope of the claims. An embodiment based on a proper combination of technical means disclosed in different embodiments is encompassed in the technical scope of the present invention.

As described above, the image forming apparatus in accordance with the present invention includes: an image bearing member; a charging section which (i) includes a charger case containing a discharge electrode and (ii) charges a surface of the image bearing member by a voltage application to each of the discharge electrode and the charger case; an exposure section which forms an electrostatic latent image by emitting light to the image bearing member thus charged; a developing section which includes a developer bearing member which bears toner to be supplied to the image bearing member on which the electrostatic latent image is formed; and a developer regulating section which regulates a layer thickness of the toner which is borne by the developer bearing member, the developer regulating section being electrically connected to the charger case, the developer regulating section being at least partially electroconductive.

The image forming apparatus in accordance with the present invention is arranged such that the charging section uses discharge from the discharge electrode to charge not only a surface of the image bearing member but also the toner which is borne by the developer bearing member.

According to the arrangement, discharge is used to simultaneously charge the image bearing member and the toner on the developer bearing member. This enables more efficient charging. Moreover, since the toner on the developer bearing member can be charged sufficiently, it is possible to subject the toner which is borne by the developer bearing member to a further reduced frictional force.

The image forming apparatus in accordance with the present invention is arranged such that the developer regulating section has an opening through which the light emitted from the exposure section to the image bearing member passes.

According to the arrangement, the developer regulating section which has an opening does not block the light emitted from the exposure section to the image bearing member, so that the light can be directed to the image bearing member.

The image forming apparatus in accordance with the present invention is arranged such that the charger case faces each of the image bearing member and the developer bearing member and has a grid sheet metal which has a plurality of openings.

According to the arrangement, a part of the charger case which part faces the developer bearing member is constituted by a grid sheet metal which has a plurality of openings. Therefore, discharge occurs from the discharge electrode to the developer bearing member via the openings of the grid sheet metal. The discharge enables the toner on the developer bearing member to be sufficiently charged. Since the grid sheet metal is provided between the discharge electrode and the developer bearing member, an applied voltage is satisfactorily controlled, and a voltage of the toner to be charged can be stabilized.

The image forming apparatus in accordance with the present invention is arranged such that the grid sheet metal is made of stainless steel.

According to the arrangement, there is less deterioration in material. Therefore, it is possible to maintain a sufficient material strength.

The image forming apparatus in accordance with the present invention is arranged such that the discharge electrode is a metallic wire.

According to the arrangement, it is possible to charge not only the image bearing member but also toner by a voltage application to a gap between respective wires.

The image forming apparatus in accordance with the present invention is arranged such that the discharge electrode is a needle-shaped metallic electrode.

According to the above arrangement, it is possible to charge not only the image bearing member but also toner by a voltage application to a gap between respective electrodes.

The image forming apparatus is arranged such that: the developer regulating section includes a blade sheet metal which is electroconductive and a triboelectric charging member which is made of urethane rubber and is provided to the blade sheet metal; and the triboelectric charging member charges the toner by rubbing the toner, the toner passing through a gap between the triboelectric charging member and the developer bearing member.

According to the arrangement, it is possible to charge the toner in the developing section also by the triboelectric charging member. This allows further stabilization of a charge amount of the toner.

The image forming apparatus in accordance with the present invention is arranged such that: the charging section includes four charging sections, the exposure section includes four exposure sections, and the developing section includes four developing sections; and the four developing sections store yellow toner, magenta toner, cyan toner, and black toner, respectively.

According to the above arrangement, it is possible to make the entire image forming apparatus to be smaller by efficient arrangement of each unit.

REFERENCE SIGNS LIST

21 Driven roller
23 Driving roller
30 Photoreceptor belt (Image bearing member)
33-*n* Laser scanner unit (Exposure section)
34-*n* Charging charger unit (Charging section)
39 Charger case
34*a*, 34*d* Sheet metal
34*b* Charger line (Discharge electrode)
34*c*, 34*d'* Grid sheet metal
34*e* Coil spring
34*f* Screw
34*h*, 34*i* Sheet metal holder
34*j* Electrode
35-*n* Developing device (developing section)
36 Transfer unit
37 Cleaning unit
38 Fixing device (fixing section)
40-*n* Image forming station
60 Developer
61 Developing tank
62 Developing roller
63 to 65 Stirring and carrying member
66 Toner supply roller
67 Developer regulating member
68 Doctor blade sheet metal
68*a* Opening
70 Developer regulating unit
71, 72 Fixing sheet metal
80 Intermediate wall member
81 Opening hole

The invention claimed is:

1. An image forming apparatus comprising:

an image bearing member;

a charging section which includes a charger case containing a discharge electrode and which is configured to charge a surface of the image bearing member by a voltage application to each of the discharge electrode and the charger case;

an exposure section configured to form an electrostatic latent image by emitting light to the image bearing member thus charged;

a developing section which includes a developer bearing member configured to bear toner to be supplied to the image bearing member on which the electrostatic latent image is formed; and a developer regulating section which is configured to regulate a layer thickness of the toner which is borne by the developer bearing member, the developer regulating section being attached to the charger case so as to be electrically connected to the charger case, the developer regulating section being at least partially electroconductive, the developer regulating section having an opening through which light emitted from the exposure section to the image bearing member passes.

2. The image forming apparatus as set forth in claim 1, wherein the charging section is configured to use discharge from the discharge electrode to charge not only a surface of the image bearing member but also the toner which is borne by the developer bearing member.

3. The image forming apparatus as set forth in claim 2, wherein the charger case faces each of the image bearing member and the developer bearing member and comprises a grid sheet metal which comprises a plurality of openings.

4. The image forming apparatus as set forth in claim 1, wherein the developer regulating section is directly attached to the charger case.

5. The image forming apparatus as set forth in claim 1, wherein the developer regulating section is integral with the charger case.

* * * * *